United States Patent [19]

Asari et al.

[11] Patent Number: 4,484,881

[45] Date of Patent: Nov. 27, 1984

[54] HOT ISOSTATIC PRESSING APPARATUS

[75] Inventors: Akira Asari, Osaka; Tamotsu Fukuda; Shiro Matsuura, both of Kobe, all of Japan

[73] Assignee: Kabushiki Kaisha Kobe Seiko Sho, Kobe, Japan

[21] Appl. No.: 572,051

[22] Filed: Jan. 19, 1984

Related U.S. Application Data

[63] Continuation-in-part of Ser. No. 428,656, Sep. 30, 1982, abandoned.

[30] Foreign Application Priority Data

Oct. 5, 1981 [JP] Japan ..... 56-148465
Oct. 5, 1981 [JP] Japan ..... 56-148461

[51] Int. Cl.[3] ..... B30B 11/00
[52] U.S. Cl. ..... 425/405 H; 425/406
[58] Field of Search ..... 425/405 R, 405 H, 406, 425/389

[56] References Cited

U.S. PATENT DOCUMENTS 3,241,188 3/1966 Febbo ..... 425/405 H
3,427,011 2/1969 Boyer ..... 425/405 H
3,591,903 7/1971 Bowles ..... 425/405 H
3,865,533 2/1975 Deprez ..... 425/405 H
4,238,667 12/1980 Conaway ..... 425/405 H

FOREIGN PATENT DOCUMENTS 2543503 4/1976 Fed. Rep. of Germany .

*Primary Examiner*—Caleb Weston
*Attorney, Agent, or Firm*—Oblon, Fisher, Spivak, McClelland & Maier

[57] ABSTRACT

A hot isostatic pressing apparatus including a high pressure container having an opening at least at one end thereof for loading and unloading materials or products being formed. The high pressure container is internally provided with a heat insulator and a heater. A container holding frame has an open space substantially at the center thereof for releasably holding the upper and lower ends of the high pressure container during the hot isostatic pressing stage of the operation. The container holding frame is movably supported at one side thereof on a stationary structure for movements toward and away from the high pressure container.

14 Claims, 21 Drawing Figures

HOT ISOSTATIC PRESSING APPARATUS

CROSS REFERENCE TO RELATED PATENT APPLICATION

This application is a continuation-in-part of application Ser. No. 428,656, filed Sept. 30, 1982, and abandoned subsequent to the filing of this application.

BACKGROUND OF THE INVENTION

1. Field of the Invention

This invention relates generally to hot isostatic presses. More particularly, this invention relates to a hot isostatic pressing apparatus which is compact in construction and capable of performing hot isostatic pressing operations in an efficient and safe manner.

2. Description of Prior Art

Hot isostatic pressing (hereinafter referred to simply as "HIP") is known in the art as a technology which can simultaneously shape and sinter a powdery material in a high-pressure and high-temperature gas atmosphere. One of the advantages of HIP technology is that it prevents the coarsening of crystal grains due to excessive growth, thereby obtaining products having fine structure.

In HIP apparatus, it is necessary to transfer the material or product being formed into and out of a high pressure container in each cycle of operation. This transfer of the material or product being formed is now customarily performed using the procedures and apparatus illustrated in FIGS. 1(a) to **1(*d*) and FIG. 2**.

Referring first to FIGS. 1(a) to 1(d), indicated at 1 is a high pressure container which is provided with an upper plug 2. A corresponding lower plug 3 is mounted on a lift member 6. The high pressure container 1 is internally provided with a heat insulator 4 and a heater (not shown). A material or product to be formed 9 placed on the lower plug 3 is loaded into and unloaded from the high pressure container 1 by upward and downward movements of the lift member 6 along posts 8. Subsequent to the preparatory stages shown in FIGS. **1(*a*) to 1(*c*), the high pressure container 1 is received in a center open space 5A of a rectangular holder frame 5. As shown in FIG. 1(*d*), the rectangular holder frame 5 contacts and presses against the upper and lower plugs 2 and 3. The rectangular holder frame 5 is mounted on a carriage 10 which is movable on rails 7. The frame 5 is used to reinforce lower ends of the high pressure container 1 against the upward and downward forces which act on the upper and lower plugs 2 and 3 during the HIP treatment, which takes place at high pressure and temperature. After a predetermined time period of HIP treatment, the carriage 10 is moved away from the high pressure container 1, and the now formed material or product 9 is taken out of the high pressure container 1**.

Illustrated in FIG. 2 is a HIP apparatus including a high pressure container 11 mounted on a support frame 16. The upper and lower ends of the high pressure container 11 are closed with upper and lower plugs 12 and 14. Air-tightness of the closure is insured by means of seal blocks 12A and 14A, respectively. A heat insulator 15 and heating elements llA are provided to permit the processing of the materials or products to be performed under high-temperature and high-pressure conditions. The holder frame 5 is moved back and forth on a carriage 17 by a piston-cylinder 18. Indicated at 19 is a pusher carriage, at 20 is a pusher, and at 21 are rails for the pusher carriage 19.

In the conventional HIP apparatus shown in FIGS. 1 and 2, the holder frame 5 which is provided to withstand the upward and downward forces in the high pressure container 1 or 11 is transferred toward and away from the container at the time of loading and unloading the materials or products to be formed. Accordingly, the HIP apparatus as a whole is very heavy and needs a great deal of floor space for installation. Moreover, the convention HIP apparatus shown in FIGS. 1 and 2 suffers from the problem of low productivity due to the long cycle time of the HIP operation.

Furthermore, the conventional HIP apparatus which utlizes an ultra high pressure gas (i.e., on the order of about 2000 kg/cm$^2$) is usually provided with surrounding partition walls in order to protect against prossible accidents. In the connection, it has been the usual practice for the manufacturers of the HIP apparatus to design the HIP apparatus itself separately from the protective partition walls, leaving the problem of construction of the protective partitition walls in the hands of the ultimate users of the apparatus. However, this arrangement has not been entirely satisfactory because the ultimate users of the HIP apparatus are frequently inexperienced in the construction of such walls.

OBJECTS OF THE INVENTION

The present invention is intended to eliminate or ameliorate the above-mentioned drawbacks or problems of conventional HIP apparatus.

It is the principal object of the present invention to provide a HIP apparatus of relatively compact construction, which has fewer component parts than conventional HIP apparatus, and which has a shorter cycle time than convention HIP apparatus.

It is a more particular object of the present invention to provide HIP apparatus which integrally includes a protective partition wall mounting thereon a high pressure container or a holder frame for the high pressure container.

It is another object of the present invention to provide HIP apparatus employing a holder frame which is hinged at one side to a stationary structure for pivotal movement toward and away from a high pressure container.

SUMMARY OF THE INVENTION

These and other objects are obtained according to the present invention by means illustrated in detail hereinafter. In general terms, however, HIP apparatus according to the present invention includes a high pressure container having an opening formed in at least one end thereof for loading and unloading materials and products to be formed. The high pressure container is internally provided with a heat insulator and a heater. A holder frame is provided which has an open space substantially at the center thereof for releasably holding the upper and lower ends of the high pressure container in the hot isostatic pressing stage of the operation. The container holder frame is movably supported at one side on a stationary structure for movements toward and away from the high pressure container.

In a preferred form of the invention, the stationary structure is a protective partition wall which surrounds the HIP apparatus. The holder frame is pivotable supported at one side on the inside of the protective partition wall for pivotal movement toward and away from a high pressure container. The high pressure container is also mounted on the protective partition wall through a suitable support member.

BRIEF DESCRIPTION OF THE DRAWINGS

FIGS. 8(*b*) and 8(*c*) are plan views of the HIP apparatus generally as shown in FIG. 8(*a*), but employing protective partition walls having different shapes.

FIGS. 9(*b*) and 9(*c*) are plan views of the HIP apparatus generally as shown in FIG. 9(*a*), but employing protective partition walls having different shapes.

DETAILED DESCRIPTION OF THE PREFERRED EMBODIMENTS

Figure 1A:
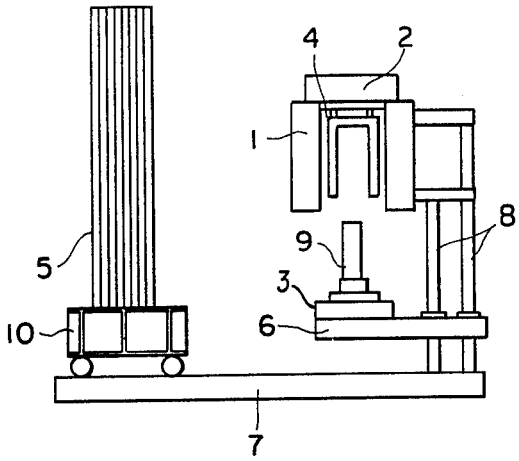
FIGURE 1(a) PRIOR ART
FIGS. 1(*a*) to 1(*d*) are schematic side elevational views of a conventional HIP apparatus in various phases of operation.
Figure 1B:
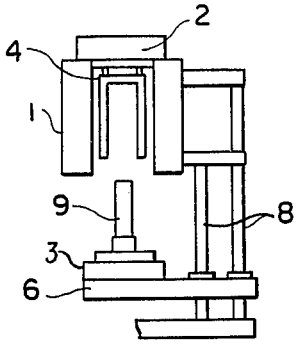
FIGURE 1(b) PRIOR ART
Figure 1C:
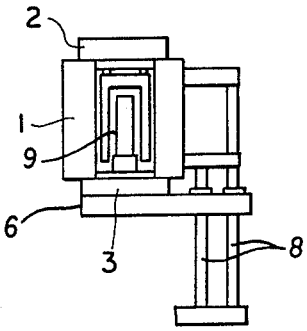
FIGURE 1(c) PRIOR ART
Figure 1D:
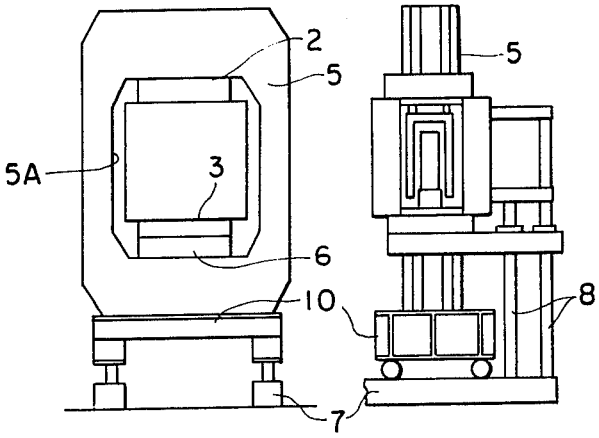
FIGURE 1(d) PRIOR ART
Figure 2:
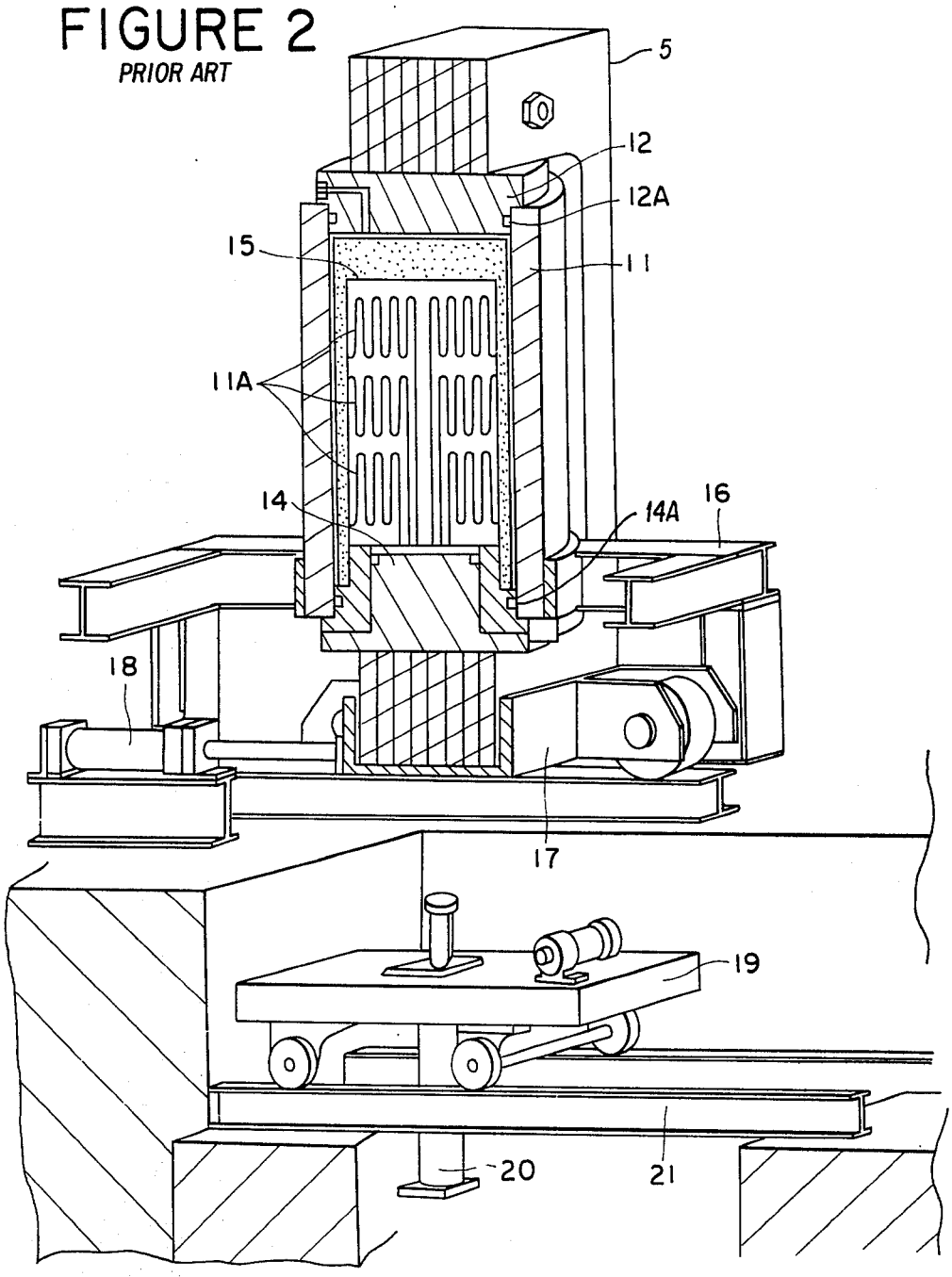
FIGURE 2 PRIOR ART
FIG. 2 is a schematic, perspective, partially sectional view showing the general arrangement of the conventional HIP apparatus shown in FIGS. 1(*a*) to 1(*d*).
Figure 3A:
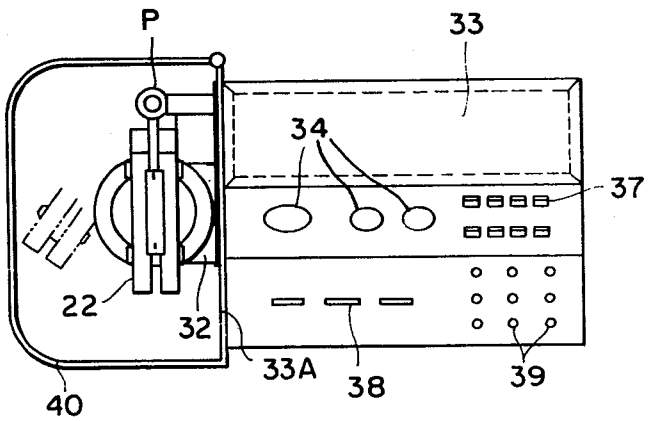
FIGS. 3(*a*) to 3(*c*) are schematic plan views of a small-sized HIP apparatus incorporating the present invention.
Figure 3C:
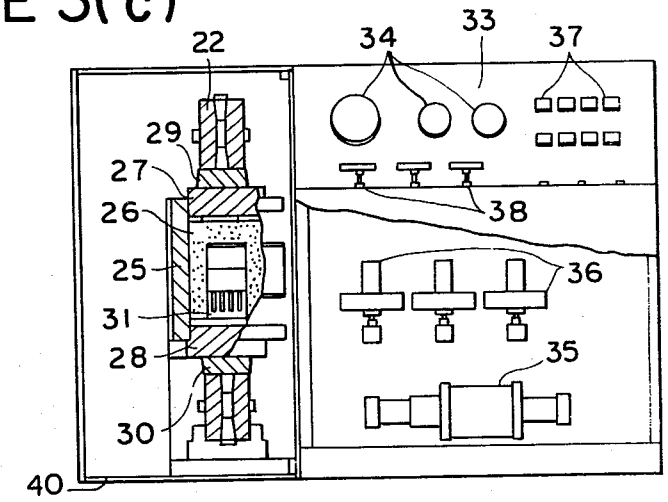
Figure 3B:
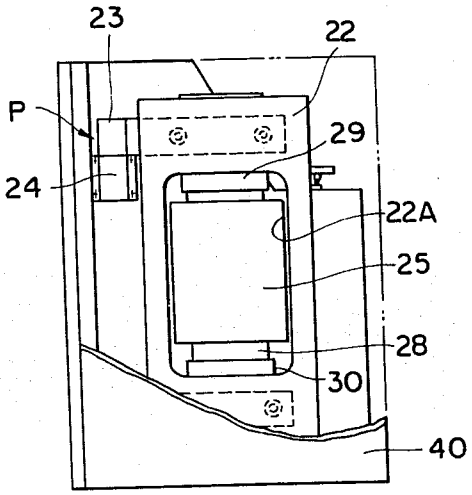

In FIGS. 3(*a*) to 3(*c*), a base plate 33A is securely fixed to one side of an upright side wall of a panel body 33 by a bracket 32. Pressure gauges 34, a compressor 35, automatic valves 36, indicator lamps 37, manual valves 38, push button switches 39, etc. are mounted on the panel body 33. Hinge members 24 are fixed in upper and lower positions on one side of the base plate 33A.

Denoted at 22 is a pivotally mounted container holding frame which has a central rectangular open space 22A for releasably holding a high pressure container 25 therein. More particularly, hinge members 23 are provided in upper and lower positions on one side of the holding frame 22. The hinge members 23 are pivotally connected to the upper and lower hinge members 24 on the base plate 33A. The hinge members 23, 24 constitute a pivotal joint P which which permits pivotal movements of the holding frame 22 about a vertical axis. In the particular example shown, the holding frame 22 releasably engages the upper and lower ends of the high pressure container 25.

The high pressure container 25 is internally provided with a heat insulator 26 and heater 31. The upper and lower ends of the high pressure container 25 are hermetically closed by upper and lower plugs 27 and 28, respectively. The outer end faces of the upper and lower plugs 27 and 28 are releasably engaged by upper and lower platens 29 and 30 which are mounted on the holding frame 22 in vertically opposing positions across the central open space 22A in the holding frame 22.

Figure 4:
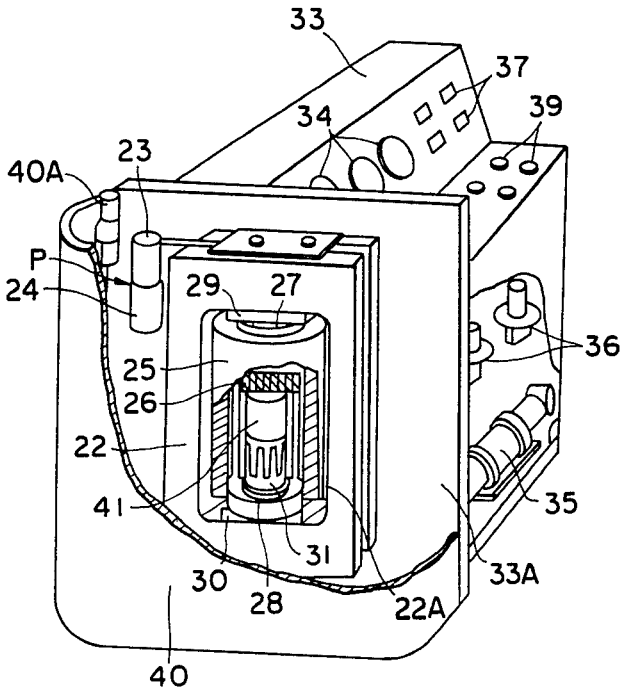
FIG. 4 is a schematic, perspective, partially sectional view showing the general arrangement of the small-sized HIP apparatus shown in FIG. 3.

Reference numeral 40 denotes a protective partition wall which is pivotally connected at one end to the base plate 33A by hinges 40A (shown in FIG. 4). The protective partition wall 40 is arranged to surround the whole HIP assembly, including the holding frame 22.

FIG. 4 illustrates in a perspective view a product or material 41 which is undergoing HIP treatment in the high pressure container 25 in the above-described HIP apparatus. The product or material 41 is loaded in the high pressure container 25 from beneath. Access to the interior of the high pressure container 25 is provided by extraction of the lower plug 28.

Figure 5A:
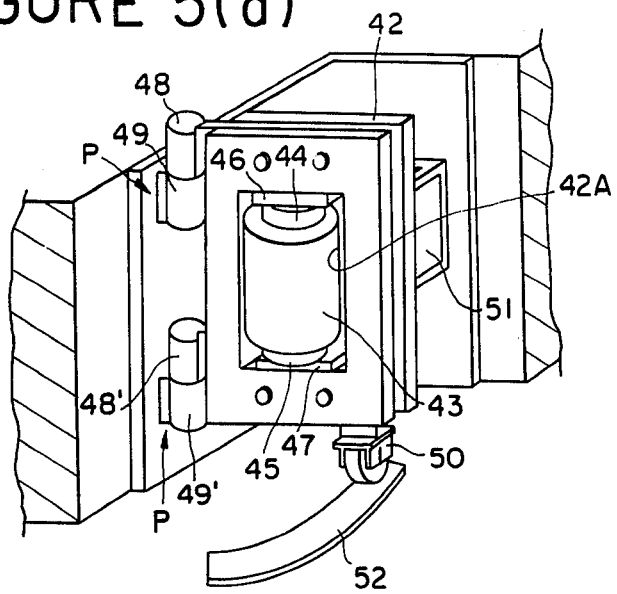
FIGS. 5(*a*) and 5(*b*) are fragmentary perspective views of medium- and large-sized HIP apparatuses incorporating the present invention.
Figure 5B:
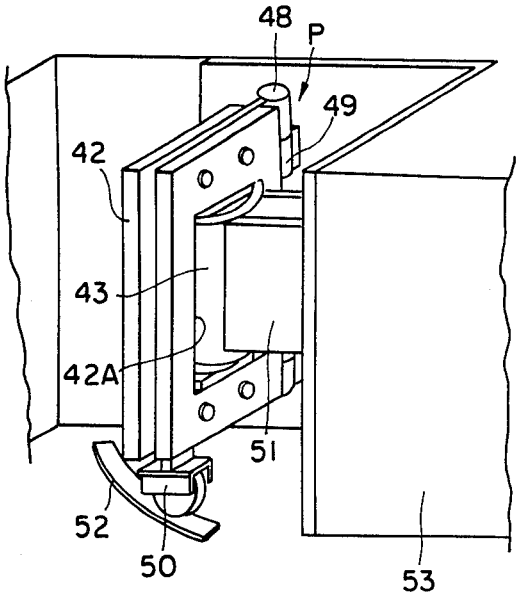

FIGS. 5(*a*) and 5(*b*) show a second embodiment of HIP apparatus incorporating the present invention. This embodiment differs from the embodiment of FIGS. 3 and 4 in that the HIP assembly is mounted on a partition wall which is separate from the control panel. More particularly, the second embodiment includes a high pressure container 43 having upper and lower plugs 44 and 45. Although not shown, a heat insulator and a heater are internally provided in the second embodiment in the fashion illustrated in the first embodiment. The high pressure container 43 is securely mounted on a partition wall 53 through a bracket 51.

A holder frame 42 which releasably holds the high pressure container 43 through upper and lower platens 46 and 47 is pivotally connected on one side to the partition wall 53 through hinge members 48 and 48'. The hinge members 48 and 48' are fixed in upper and lower portions of the holder frame 42 and positioned to engaged opposing hinge members 49 and 49' on the partition wall 53 to form pivotal joints P which permit pivotal movement of the holder frame 42 about a vertical axis. By the pivotal movement about the pivotal joints P, the holder frame 42 can be pivoted toward and away from the partition wall 53 to releasably receive the high pressure container 43 in the rectangular open space 42A at the center of the holder frame 42. In the particular embodiment shown, in order to ensure smooth and easy pivoting movements of the holder frame 42 and to facilitate its positioning around the high pressure container 43, the holder frame 42 is provided with a wheel 50 which runs on a guide rail 52.

Figure 6A:
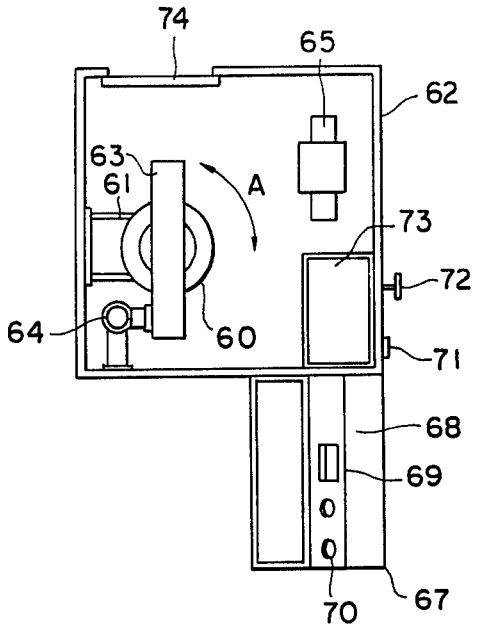
FIGS. 6(*a*) and 6(*b*) are a plan view and a front view, respectively, of a third embodiment of the invention.
Figure 6B:
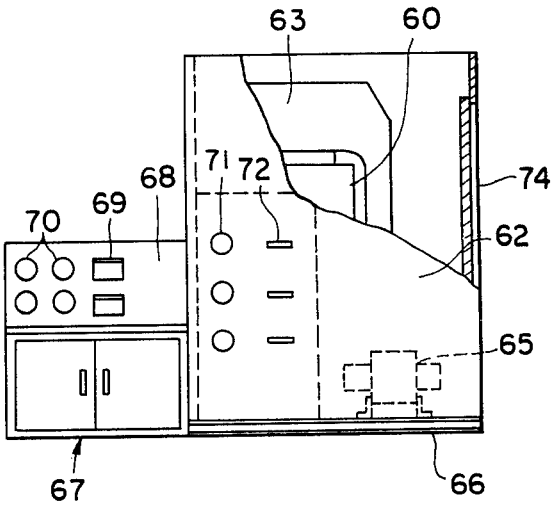

Referring now to FIGS. 6(*a*) and 6(*b*), there is shown a third embodiment of the present invention. In this embodiment, a high pressure container 60 is similarly mounted on a protective partition wall 62 through a bracket member 61. The high pressure container 60 is also similarly internally provided with a heat insulator and a heater (not shown), and it similarly has its open upper and lower ends hermetically sealed by detachable upper and lower plugs in the same manner as in the foregoing embodiments.

A holder frame 63 which is designed to withstand the axial forces in the high pressure container 60 is similarly pivotally connected at one side thereof to the protective partition wall 62 by upper and lower hinge member 64. The hinge members 64 permit pivotal movements of the holder frame 63 toward and away from the high pressure container 60 as indicated by the double-headed arrow A in FIG. 6(*a*).

Reference numeral 65 denotes a compressor serving as an ultra high pressure gas generator. The compressor 65 is located within the enclosing protective partition wall 62. In the particular embodiment, the partition wall 62 is arranged substantially in a rectangular form which surrounds the main component parts of the HIP apparatus, including the high pressure container 60. Thus, the partition wall 62 partitions off the HIP apparatus from a space required for the control of the operation, maintaining a safe distance from the apparatus the magnitude of which varies according to the magnitude of energy in the high pressure container 60. The protective partition wall 62 is erected on a base frame 66, and a control panel 67 is located outside the protective partition wall 62. The control panel 67 includes a panel 68, recorders 69, ammeters 70, pressure gages 71, manual valve 72, and the like. Indicated at 73 is a valve stand, and at 74 is a door which is provided in the protective partition wall 62.

Figure 7A:
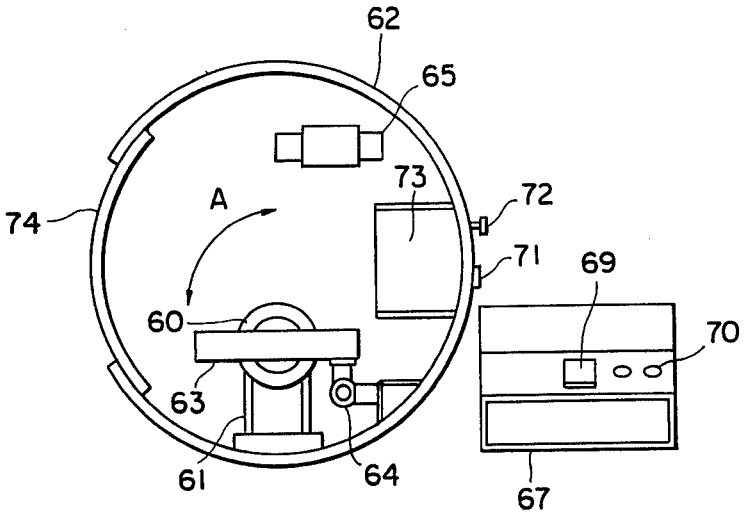
FIGS. 7(*a*) and 7(*b*) are views similar to FIGS. 6(*a*) and 6(*b*), but showing a fourth embodiment of the invention.
Figure 7B:
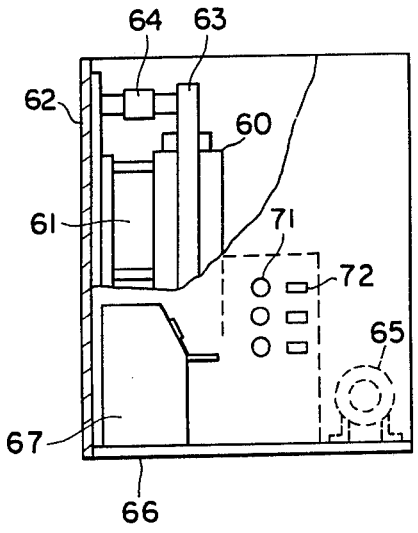

Referring to FIGS. 7(*a*) and 7(*b*), there is shown a fourth embodiment of the invention. This embodiment is the same as the previously described embodiment except for the fact that the protective partition wall 62 is in a circular form. Thus, a detailed description of this embodiment will be omitted.

Figure 8A:
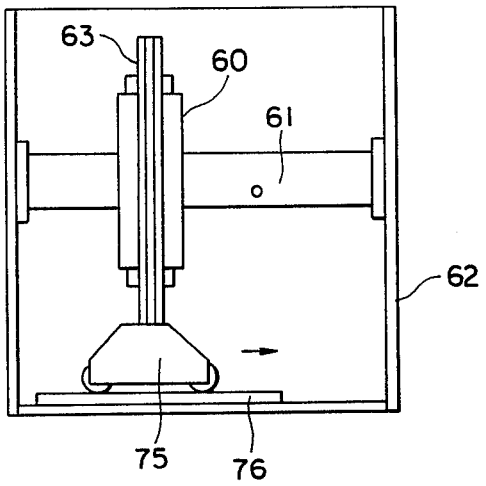
FIG. 8(*a*) is a front elevational view of a fifth embodiment of the invention.
Figure 8B:
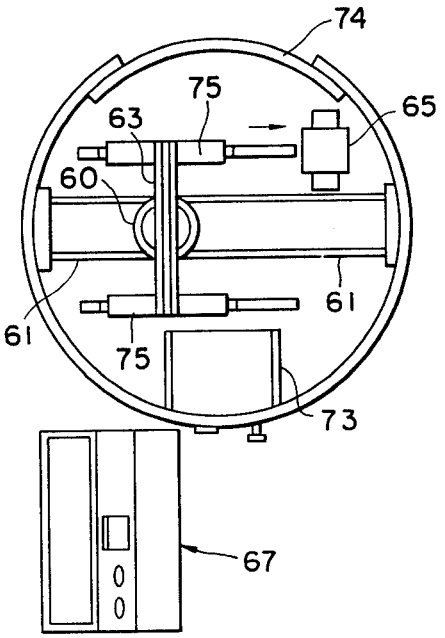
Figure 8C:
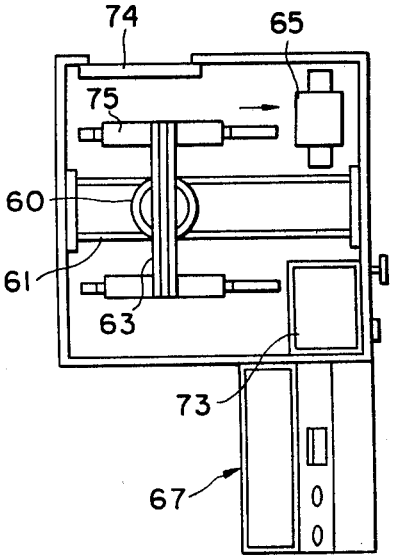
Figure 9A:
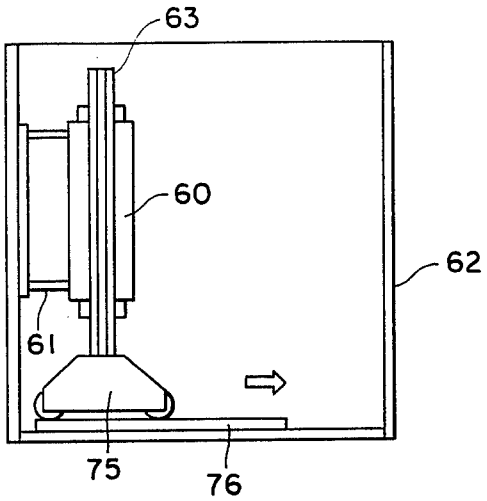
FIG. 9(*a*) is a front view of a sixth embodiment of the invention.
Figure 9B:
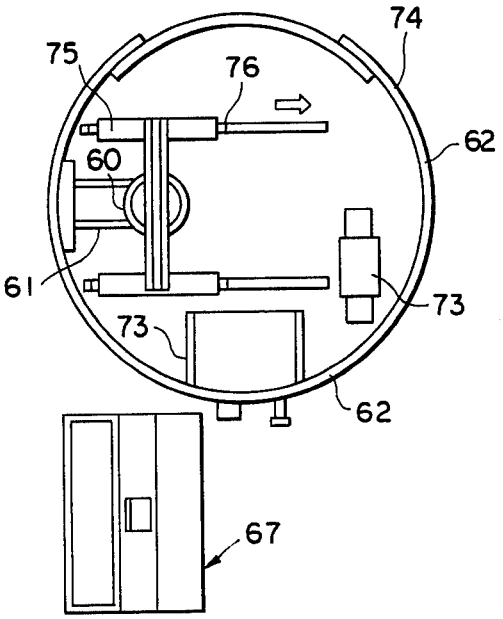
Figure 9C:
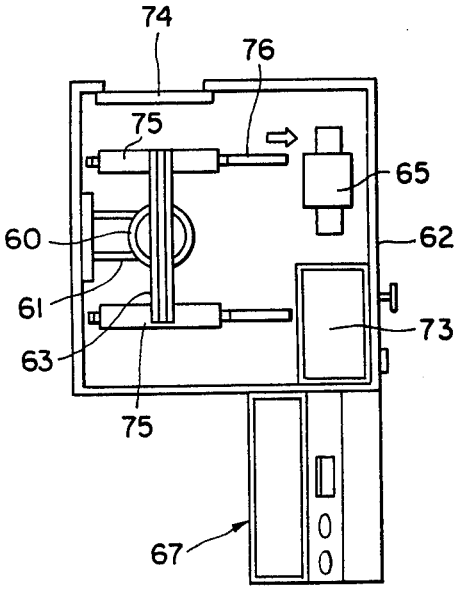

FIGS. 8(*a*) to 8(*c*) and FIGS. 9(*a*) to 9(*c*) illustrate further embodiments incorporating the present invention. However, these embodiments employ reciprocating holder frames rather than the pivoting holder frames of the previously described embodiments. More particularly, in the embodiment of FIG. 8(*a*), a high pressure container 60 is supported on a protective partition wall 62 through a transverse frame 61. The transverse frame 61 is supported on the protective partition wall 62 at its opposite ends. The holder frame 63 is supported on a wheeled pedestal 75 which is reciprocatingly movable on guide rails 76. FIGS. 8(*b*) and 8(*c*) illustrate embodiments which employ the same arrangement of the component parts in circular and square protective walls 62, respectively.

The embodiments shown in FIGS. 9(*a*) through 9(*c*) employ the reciprocating frame in combination with a high pressure container 60 which is mounted on the protective wall through a cantilever type bracket 61. FIGS. 9(*b*) and 9(*c*) show examples employing circular and square protective partition walls 62, respectively. The components common to FIG. 8(*a*) to 8(*c*) are designated by like reference numerals.

As is clear from the forgoing description, in HIP apparatus according to the present invention, one side of the holder frame is movably connected to a stationary structure, such as the base plate 33A or the partition wall 53, for movements toward and away from the high pressure container. Accordingly, it is possible to eliminate the separate carriage for the holder frame used in the prior art and to economically simplify the construction of the HIP apparatus by the use of brackets, rail supports, and pushers of reduced weight. Moreover, the invention permits a reduction in the number of component parts and an improvement in durability. In addition, the apparatus of the invention has significant advantages in that the productivity of the apparatus is enhanced markedly by the simplification of the HIP cycle. Thus, the user's needs can be met at a lower cost.

Although the container has been shown as having its upper and lower open ends hermetically closed by the upper and lower plugs, a high pressure container may be provided which has an opening only in one end with a detachable enclosure (e.g., a plug as in the foregoing embodiments) for loading and unloading materials or products through that end only.

CAVEAT

While the present invention has been illustrated by detailed descriptions of a number of embodiments, it will be obvious to those skilled in the art that various changes in form and detail can be made therein without departing from the true scope of the invention. For that reason, the invention must be measured by the claims appended hereto and not by the foregoing preferred embodiments.

We claim:

1. A hot isostatic pressing apparatus comprising:
(a) a container having an opening formed in at least one end thereof, said container being adapted to contain high pressure during use of said apparatus;
(b) a plug sized and shaped to fit releasable in said opening to close said container;
(c) a holder frame sized and shaped to surround said container and to provide support to said plug when said container is pressurized; and
(d) means for pivoting said holder frame back and forth between a work position in which said holder frame surrounds said container and provides support for said plug and a rest position in which said plug may be removed from said opening.

2. The apparatus of claim 1 and further comprising:
(a) a support member and
(b) an upright base plate mounting said container on one side thereof through said support member.

3. The apparatus of claim 2 and further comprising:
(a) a control panel and
(b) means for mounting said base plate on one side of said control panel.

4. The apparatus of claim 1 and further comprising:
(a) a rail and
(b) a wheel mounted on said holder frame in position to run on said rail during pivotal movement of said holder frame.

5. The apparatus of claim 1 and further comprising a protective partition wall enclosing said container, said holder frame, and said means for pivoting said holder frame.

6. The apparatus of claim 1 wherein:
(a) said container has an opening formed at both ends thereof;
(b) a plug is releasably fitted into each of said openings to close said container; and
(c) in its work position, said holder frame bears against and supports both of said plugs.

7. A hot isostatic pressing apparatus comprising:
(a) a container having an opening formed in at least one end thereof, said container being adapted to contain high pressure during use of said apparatus;
(b) a plug sized and shaped to fit releasably in said opening to close said container;
(c) a holder frame sized and shaped to surround said container and provide support for said plug when said container is pressurized;
(d) a protective partition wall enclosing said container and said holder frame; and
(e) means operatively connected to said partition wall for moving said holder frame back and forth between a work position in which it surrounds said container and provides support for said plug and a rest position in which said plug may be removed from said opening.

8. The apparatus of claim 7 wherein said holder frame is pivotably connected to said partition wall.

9. The apparatus of claim 8 and further comprising:
(a) a rail and (b) a wheel mounted on said holder frame in position to run on said rail during pivotal movement of said holder frame.

10. The apparatus of claim 8 and further comprising:

(a) a support member and (b) an upright base plate mounting said container on one side thereof through said support member.

11. The apparatus of claim 10 and further comprising:

(a) a control panel and (b) means for mounting said base plate on one side of said control panel.

12. The apparatus of claim 7 wherein said holder frame is reciprocably connected to said partition wall.

13. The apparatus of claim 12 and further comprising:

(a) a rail and (b) a wheel mounted on said holder frame in position to run on said rail during reciprocal movement of said holder frame.

14. The apparatus of claim 7 wherein:

(a) said container has an opening formed in both ends thereof;

(b) a plug is releasably fitted into each of said openings to close said container; and (c) in its work position, said holder frame bears against and supports both of said plugs.

* * * * *